US005183220A

United States Patent [19]

Cencula

[11] Patent Number: 5,183,220

[45] Date of Patent: Feb. 2, 1993

[54] TOW ROPE BOBBIN ASSEMBLY

[76] Inventor: Arthur A. Cencula, 20772 W. Verona, Lake Villa, Ill. 60046

[21] Appl. No.: 639,578

[22] Filed: Jan. 9, 1991

Related U.S. Application Data

[63] Continuation of Ser. No. 391,494, Aug. 9, 1989, abandoned.

[51] Int. Cl.[5] ..... B65H 75/34

[52] U.S. Cl. ..... 242/85.1; 242/86.5 A

[58] Field of Search ..... 242/85.1, 86, 86.5 R, 242/86.5 A, 100; 114/254

[56] References Cited

U.S. PATENT DOCUMENTS

| | | | |
|---|---|---|---|
| 2,765,991 | 10/1956 | Frey et al. | 242/86.5 R |
| 2,893,045 | 7/1959 | Dalbec | 242/85.1 |
| 2,918,049 | 12/1959 | Stockfleth | 242/85.1 |
| 2,998,796 | 9/1961 | Wittrock | 242/86.5 |
| 3,113,547 | 12/1963 | Stewart | 114/235 |
| 3,208,586 | 9/1965 | Wilson | 206/53 |
| 3,679,151 | 7/1972 | Rice | 242/85 |
| 3,813,055 | 5/1974 | Pickrell | 242/86.5 A |
| 3,831,545 | 8/1974 | Cain | 114/235 WS |
| 3,840,713 | 10/1974 | Carpentier | 242/85.1 X |
| 3,926,383 | 12/1975 | McConnell | 242/85.1 |
| 4,042,187 | 8/1977 | Snyder | 242/86.5 R |
| 4,077,583 | 3/1978 | McGinnis | 242/85.1 |
| 4,098,213 | 7/1978 | McGinnis | 242/86.5 A X |
| 4,133,496 | 1/1979 | Zetah | 242/86.5 |
| 4,163,529 | 8/1979 | Krenzer et al. | 242/85.1 |
| 4,229,900 | 10/1980 | Collins | 242/85.1 X |
| 4,322,198 | 3/1982 | Zuber | 242/86.5 R |
| 4,437,622 | 3/1984 | Heider | 242/86.5 R |
| 4,809,924 | 3/1989 | Martens et al. | 242/86.5 R |

*Primary Examiner*—Daniel P. Stodola
*Assistant Examiner*—John P. Darling
*Attorney, Agent, or Firm*—Potthast & Ring

[57] ABSTRACT

A bobbin (14) is cantilever mounted to an upright member (14A) of an L-shaped bracket assembly (12) which in turn has a planar base member (12B) releasibly mounted to the rear deck (16) of a boat by means of suction cups (18A, 18B, 18C). The bobbin (14) extends in a direction substantially parallel to the underlying base member (12B) and is spaced from the base member (12B) to enable hand wrapping of the coil of rope (24) from the distal end of the bobbin (14). The bobbin (14) is releasably mounted to the upright bracket member (12A) for complete removal from a cylindrical bearing hole (32) the bracket assembly (12) or for axial rotary movement for winding the rope (24) using handles (34A, 34B, 34C) or for mounting the bobbin (14) to extend from the upright bracket member (12A) in a direction opposite to that of the base member (12B).

3 Claims, 3 Drawing Sheets

TOW ROPE BOBBIN ASSEMBLY

This application is a continuation of application Ser. No. 07/391,494, filed Aug. 9, 1989, now abandoned.

BACKGROUND OF THE INVENTION

This invention relates to a tow rope bobbin assembly and, more particularly, to a tow rope bobbin assembly of the nonrotary type.

Tow rope bobbin assemblies of the rotary type for skiing and the like are well known as shown by U.S. Pat. Nos. 3,113,547 issued Dec. 10, 1963 to Stewart; 3,813,055 issued May 28, 1974 to Pickrell; 3,831,543 issued Aug. 27, 1974 to Cain and 4,133,496 issued Jan. 9, 1979 to Zetah. In each of these devices, the bobbin about which the rope is coiled has a central axis to which it is mounted for rotational movement to pay out rope or to reel in rope. A disadvantage of these units is that because of the axial mounting and reeling apparatus, the stresses created require metal parts and complicated mechanism which are expensive, difficult to carry and to mount, and suffer from wear and tear due to the reeling of rope while under tension by a skier being towed. These devices are too heavy to float if they fall overboard and are not designed for portability or releasible attachment to the back of a boat or the like.

Some of these disadvantages are overcome by nonrotational ski rope bobbins in which the rope is paid out axially from a stationary bobbin. In U.S. Pat. No. 3,208,586 issued Sep. 28, 1965 to Wilson, a plastic ski rope reel assembly stationary design must be hand held in order to be used and, thus, is unsuitable when there is only the driver in the boat who cannot simultaneously steer the moving boat while paying at the rope of the end of the nonrotating bobbin. In U.S. Pat. No. 4,163,529 issued Aug. 7, 1979 to Kenzer et al., a stationary bobbin is provided with suction cups to releasibly mount one end of the bobbin to the rear deck of a motor boat. Unfortunately, this results in the bobbin axle being directed upwards instead of horizontally backwards toward the skier. Disadvantageously, in order to overcome this problem, a ski rope guide must be movably mounted to the bobbin to change the vertical rope paying-out to a horizontal rearward paying-out.

SUMMARY OF THE INVENTION

Therefore, it is the object of the present invention to provide a top rope bobbin assembly which overcomes the aforementioned problems of known ski rope reels and bobbins noted above.

This objective is achieved in part by providing a tow rope bobbin assembly comprising a bobbin having a stationary shaft for support of a coil of rope wrapped therearound and a mounting bracket assembly for horizontal mounting of the bobbin. The mounting bracket assembly includes a bracket body, means for attaching the bracket body to an underlying surface and means for cantilever stationary mounted of said bobbin to said bracket body with its shaft substantially parallel to said underlying surface and in spaced relationship therewith. This eliminates the need for the movably mounted guide required in the known bobbin of this type noted above.

Another objective is achieved by provision of a tow rope bobbin assembly comprising a bobbin having a shaft for supported of a coil of rope wrapped therearound and a releasible mounting bracket for releasibly mounting of the bobbin. The releasible mounted bracket includes a bracket body, means for attaching the bracket body to an underlying surface, and means for releasibly mounting said bobbin in a stationary position to said bracket body. In one embodiment, collars are removed from the bobbin shaft, and in another embodiment, the bracket has a hinged connection to allow release of the bobbin from the bracket body.

Further, an objective is to provide a ski rope bobbin assembly including a bobbin with a shaft for support of a coil of rope wrapped therearound and a mounting bracket assembly including a bracket body having a pair of opposite sides, means at one of the opposite sides for releasibly mounting said bobbin to an underlying surface, and means for attaching one end of the bobbin shaft to the other one of said opposite sides of the bracket body and extending away therefrom on said other side.

Advantageously, in the preferred embodiment, the bobbin shaft is entirely removable from the bracket for winding, storage or carrying and can also be supported by the bracket for rotary movement during winding to reel in the rope. Once returned to a stationary position, the rope can be paid out axially. The mounting bracket also advantageously carries means for releasibly securing the ends of the rope to prevent inadvertent unraveling and means to releasibly hold a ski rope handle during storage or carrying.

BRIEF DESCRIPTION OF THE DRAWING

The foregoing objects and advantageous features of the invention will be explained in greater detail and others will be made apparent from the detailed description of the preferred embodiment of the tow rope bobbin assembly of the present invention which is given with reference to the several figures of the drawing, in which.

DETAILED DESCRIPTION

Figure 1:
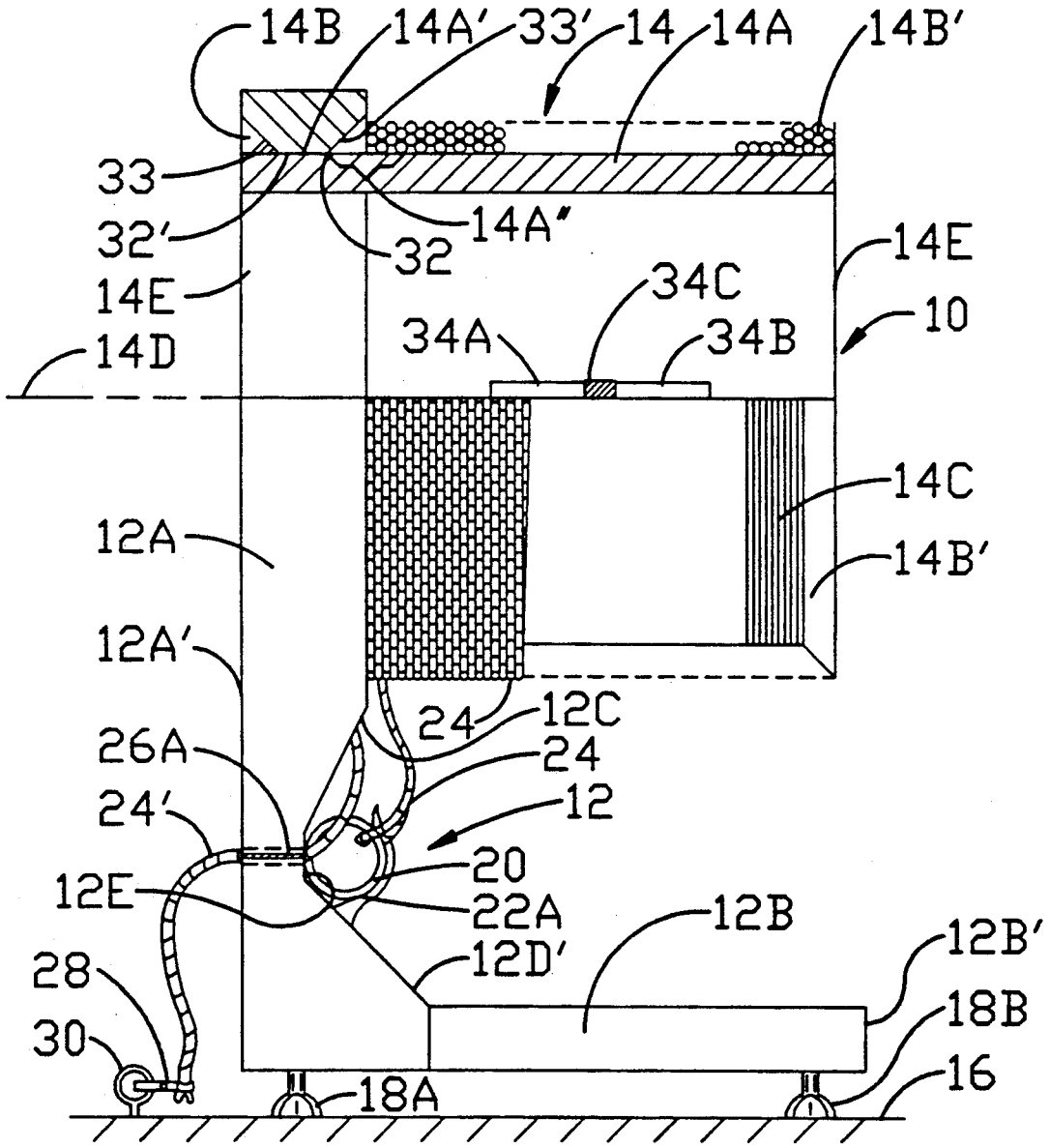
FIG. 1 is a side view of the preferred embodiment of the tow rope bobbin assembly of this invention in which the upper half is shown in cross section to illustrate the connection between the bobbin shaft and the mounting bracket.
Figure 2:
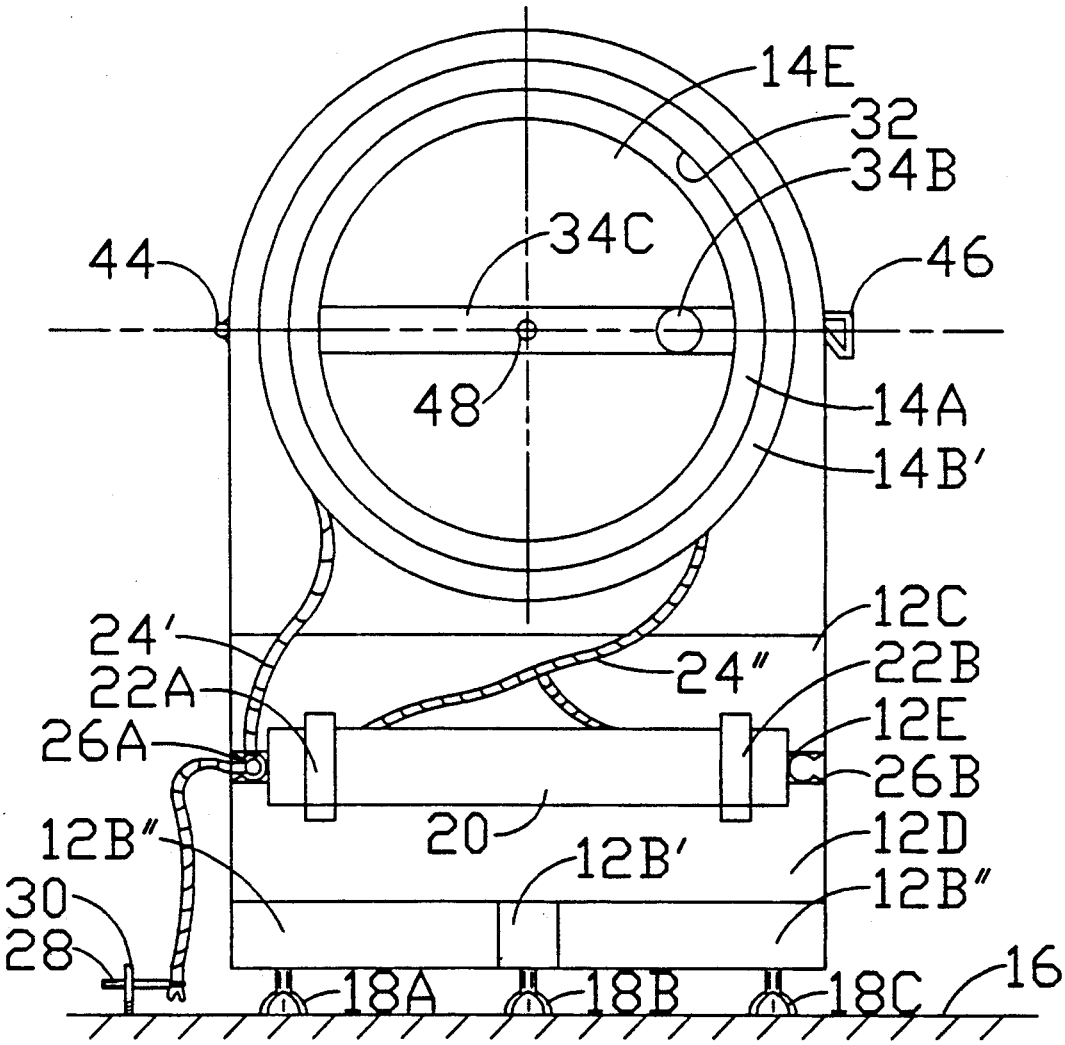
FIG. 2 is a front view of the bobbin assembly of FIG. 1.

Referring now to the drawings, particularly FIGS. 1 and 2, the preferred embodiment of the tow rope bobbin assembly 10 of the invention is seen, drawn on a reduced scale of approximately 1:2, to include an L-shaped mounting bracket assembly 12 and a stationary bobbin 14. The bobbin 14 is cantilever mounted at one end to an upright bracket member 12A which is fixedly mounted perpendicularly to a planar base member 12B to form the L-shaped bracket assembly 12.

Planar base member 12B, in turn, is releasibly mounted to the rear deck 16 of a motor boat or the like by means of three, substantially identical, suction cup leg assemblies 18A, 18B and 18C, arranged in a triangle, FIG. 2, or other releasibly fasteners. If preferred, the base member 12B is permanently mounted to a deck 16 or is releasibly mounted to brackets (not shown) which, in turn, are permanently mounted to the deck 16. In order to reduce material, the planar base member 12B has a truncated triangular shape with a front center will 12B' joined on either side by a pair of inwardly slanted walls 12B", FIG. 2. Preferably, the base member 12B and upright member 12A are integrally formed together as a single planar hollow, thin walled molded plastic piece to provide floatation air pockets for buoyancy.

A pair of beveled walls 12C and 12D on opposite sides of a neck 12E join the upright bracket member 12A to the base member 12B and also provide a recess for releasibly mounting of a ski rope handle 20 by means of a pair of plastic spring clips 22A and 22B, FIG. 2, to the bracket assembly 12, during storage. The recess advantageously provides for good hand space beneath the entire length of the bobbin 14 for hand coiling of the bobbin with a tow rope 24 even with the presence of the spring clips 22A and 22B. Alternately, the spring clips are mounted at a back wall 12A' of the vertical upright bracket member 12A.

The neck 12E also provides a narrowed section at which a pair of key hole slots 26A and 26B are provided for releasibly holding the fixed and 24' and the tow rope handle end 24" during storage. The fixed end 24' is releasibly attached to deck 16 by means of a releasible hook 28 attached to end 24' and hooked through an eyelet 30 in the deck 16. Either before or after the coil of rope 24 is unwound from the bobbin 14, it is also removed from the keyhole slot 26A and held to the boat solely by the eyelet 30 to avoid strain on the bobbin assembly 10 during towing, unlike the known ski rope reels in which the rope is attached to the bobbin during towing.

The bobbin 14 has an elongated, cylindrical shaft 14A approximately eight to ten inches long and having an elongate center axis of symmetry 14D extending through its hollow interior between openings 14E at opposite ends in a direction substantially parallel to the plane of the base member 12B. One end of the shaft 14A is releasibly mounted within a cylindrical bearing opening 32 in the upright member 12A of the bracket body. An annular beveled collar 14B fits within a matching recess 33 to block axial removal of the cylindrical shaft 14A. In addition, the cylindrical shaft 14A has a section with a rotary fastening element, such as threaded section 14A' which threadably mates with a matching threaded section 32' at the interior of the cylindrical bearing opening 32 to form a rotary fastener assembly.

The threads are of sufficient height above the otherwise smooth outer cylindrical surface of the cylindrical shaft 14A, so that when threaded sections 14A' and 32' are decoupled, the cylindrical shaft 14A is allowed to slide to a position in which a section 14A" adjacent the threaded section 14A' is supported within the cylindrical opening 32. At this section 14A" there is sufficient clearance to rotate the shaft 14A about its axis 14D within the cylindrical bearing opening 32. Once in this position, either one or both of two elongate handles 34A and 34B, FIG. 3, FIG. 2 respectively, which extend substantially parallel to the axis 14D within the interior of the shaft 14A, can be used to manually rotate the shaft 14A to reel in the rope 24 therearound if desired. After the rope 24 is wound, the shaft 14A is rotated in a direction opposite to the direction of rotation used for winding to recouple the threaded sections 14A' and 32'. Otherwise, the rope 24 is wrapped manually while the shaft 14A remains stationary. In any event, the coil of rope 24 is then ready to be uncoiled axially off the distal end of the shaft 14A while the shaft 14A is securely held in cantilevered axially stationary position by means of the coupling of the threaded sections 14A' and 32' and by means of collar 14B bearing against the beveled wall of the annular recess 33.

Alternatively, if desired the collar 14B, which, preferably, is releasibly attached to the shaft 14A by screw threads or other rotary fastener or other fastener elements, is decoupled from the end of the shaft 14A allowing the shaft 14A to be slid out of hole 32 and completely removed from the mounting bracket member 12. The handle 34C can then be used to manually hold the bobbin for manual uncoiling in the manner shown in the aforementioned U.S. Pat. No. 3,208,586 issued Sep. 28, 1965, to Wilson, if desired. The handle 34C can also be used to simply manually carry the bobbin 14 or bobbin 14 and attached mounting bracket 12 to a separate place of storage apart from the mounting bracket. Advantageously, the handle 34C also functions to support rotation handles 34A and 34B and acts as a diagonal strut to increase the structural integrity of the hollow shaft 14A.

As seen in FIG. 2, the handle 34C also has a section removed from the center of the handle 34C to form a cylindrical bore 48 centered about the axis of symmetry 14D. The bore 48 can be used to rotatably mount the bobbin 14 to a rod (not shown) to facilitate winding the bobbin when not attached to the mounting bracket.

It is also contemplated that a single mounting bracket assembly 12 could be used in conjunction with a plurality of bobbins 14 prewound with coils to successively, axially pay out ski ropes to a series of skiers.

Another object of the invention achieved by virtue of another threaded section 14C at the distal end of the shaft 14A which is substantially identical to the threaded section 14A' and which therefore also mates with the threaded section 32. This enables the shaft 14A to be mounted on the back side 12A' of the upright mounting bracket member 12A with the shaft 14A extending away from the backside 12A', opposite the direction of extension of the base member 12 and opposite the direction shown. With the second set of thread 14C, this can be accomplished by simply uncoupling threaded sections 32' and 14A', sliding the shaft 14A through the bearing hole 32 and then coupling the threaded section 14C to section 32'. When this is done, a beveled wall, annular collar 14B', substantially identical to collar 14B, which previously functioned to prevent inadvertent unraveling off the distal end, fits into a matching recess 33' in the front wall of the upright bracket member 12A and functions to block axial removal of the shaft 14A from the bearing opening 32. The collar 14B' is preferably fixedly mounted and integrally formed with the end of the shaft 14A, as seen in FIG. 2, but it can also be threaded to the shaft 14A like collar 14B. This rearward mounting is needed in some boats due to the dimensions and arrangement of the back deck relative to the rear engines or other reaward elements of the boat. If the second threaded section 14C is eliminated, then the threaded section 14A' is used to couple the bobbin 14 in reverse position after it is entirely removed from the mounting bracket 12. In that case, the collar 14B fits into recess 33' instead of into recess 33.

Figure 3:
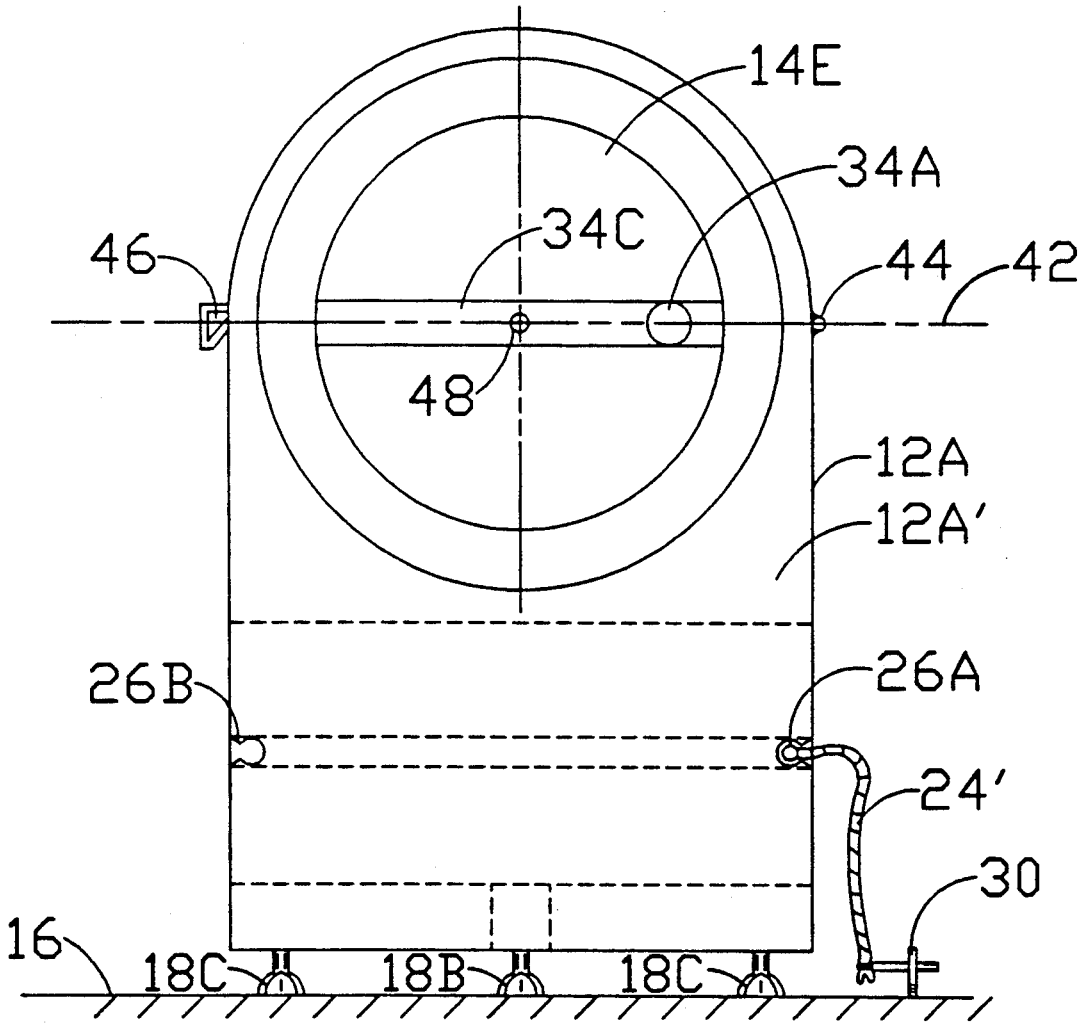
FIG. 3 is a back view of the bobbin assembly of FIGS. 1 and 2.

Referring to FIGS. 2 and 3, instead of using removable collars, another way of allowing releasible connection of the shaft 14A to the upright bracket 12A, is provision of the upper part of the upright bracket member 12A above an imaginary center plane 42 as a separate part which is joined to the part beneath center plane 42 by means of a hinge 44 on one side and a latch assembly 46 on the other side. In such case, the threaded sections 14A', 32' and 14C are eliminated, and both the collars 14B and 14B' are preferably integrally formed with the shaft 14A.

While a detailed description of the preferred embodiment of the invention has been given, it should be appreciated that many variations can be made thereto without departing from the scope of the invention as set forth in the appended claims. While the different forms disclosed here include a plurality of parts which are assembled to achieve various advantages noted above, the basic objective can be achieved in an embodiment in which the entire assembly 10 is made of a single piece of molded plastic with no moving or releasibly connected parts.

I claim:

1. A tow rope bobbin assembly, comprising:

a bobbin having a stationary shaft for supportive contact with a coil of rope wrapped therearound; and a mounting bracket assembly including a bracket body, means for attached the bracket body to an underlying surface, and means for cantilever stationary mounting of said bobbin to said bracket body with the stationary shaft of the bobbin substantially parallel to said underlying surface and in spaced relationship therewith; and means carried by an end of the shaft for releasibly holding the shaft against rotation relative to the bracket body including a hinged part pivotally connected to said bracket body that is moveable between a position in which the shaft is released from said bracket body and another position in which the shaft is not released from the bracket body.

2. The tow rope bobbin assembly of claim 1 in which said rotary supporting means includes a rotary bearing at an axial center of the shaft for receipt of an axle for rotational movement after detachment from the cantilever stationary mounting means.

3. The tow rope bobbin assembly of claim 1 in which said supporting means includes a rotary bearing carried by the bracket body and surrounding an end portion of the shaft.

* * * * *